United States Patent [19]

Satoh et al.

[11] Patent Number: 5,003,714

[45] Date of Patent: Apr. 2, 1991

[54] FIGURE MOVING ARTICLE

[75] Inventors: Yasuta Satoh; Yasuyuki Moriyama, both of Nagareyama, Japan

[73] Assignee: Takara Co., Ltd., Tokyo, Japan

[21] Appl. No.: 521,738

[22] Filed: May 10, 1990

[30] Foreign Application Priority Data

May 11, 1989 [JP] Japan ..... 1-54190[U]

[51] Int. Cl.[5] ..... G09F 19/08

[52] U.S. Cl. ..... 40/414; 40/411; 446/175

[58] Field of Search ..... 40/411, 414, 439, 455, 40/477, 610; 272/8 N, 27 N; 446/278, 330, 352, 353, 299, 175

[56] References Cited

U.S. PATENT DOCUMENTS

| | | | |
|---|---|---|---|
| 1,261,300 | 4/1918 | Saxon | 446/330 |
| 3,119,201 | 1/1964 | Brown et al. | 446/175 |
| 3,444,646 | 9/1966 | Domashovetz | 446/175 |
| 3,458,950 | 8/1969 | Tomaro | 446/175 |
| 4,097,917 | 6/1978 | McCaslin | 446/175 X |
| 4,516,951 | 5/1985 | Saigo et al. . | |
| 4,545,775 | 10/1985 | Kim | 446/299 |
| 4,717,364 | 1/1988 | Furukawa | 446/175 |
| 4,765,079 | 8/1988 | Takahashi | 40/439 |
| 4,775,351 | 10/1988 | Provenzano, Jr. | 446/175 |
| 4,850,930 | 7/1989 | Sato et al. | 446/175 |
| 4,903,424 | 2/1990 | Satoh et al. | 40/414 |
| 4,943,256 | 7/1990 | Symons | 446/278 |

FOREIGN PATENT DOCUMENTS

| | | |
|---|---|---|
| 0237083 | 7/1925 | United Kingdom . |
| 1305333 | 1/1973 | United Kingdom . |
| 2221401 | 7/1990 | United Kingdom . |

*Primary Examiner*—Kenneth J. Dorner
*Assistant Examiner*—J. Bonifanti
*Attorney, Agent, or Firm*—Price, Gess & Ubell

[57] ABSTRACT

A figure moving article capable of giving a viewer much interest and surprise and establishing any communication with the viewer. The figure moving article is constructed so as to exhibit deformation such as torsion, bending, rotation, expansion, contraction or the like by carrying out circular movement or oscillation movement in response to the action of a viewer such as hand clapping, vibration or the like.

22 Claims, 4 Drawing Sheets

FIGURE MOVING ARTICLE

BACKGROUND OF THE INVENTION

This invention relates to a figure moving article, and more particularly to a figure moving article of a post- or cylinder-like appearance suitable for use as a movable toy, a movable interior decoration or the like which exhibits unique movement sufficient to give a viewer much interest and surprise.

A conventional device used for such a purpose is divided into two types or a device of the stationary type and a device of the movable type including a spiral spring or a combination of a motor and gears which permits the device to mechanically repeatedly carry out the same operation after it is manually started.

Unfortunately, the conventional device constructed as described above fails to establish any psychological communication between a viewer and the device. Thus, it will be noted that the conventional device does not exhibit any function and/or action sufficient to permit a viewer's heart to be softened.

Accordingly, it would be highly desirable to develop a figure moving article which is capable of generating much interest in the viewer such as to establish communication with a viewer and/or surprise.

SUMMARY OF THE INVENTION

In accordance with the present invention, a figure moving article is provided. The figure moving article includes a casing of a cylindrical shape such as a simulated can which includes a cylindrical member made of a flexible material and a pair of lid members for covering both ends of the cylindrical member which are made of a rigid material. In the casing is arranged a drive mechanism which includes a motor, a power supply for driving the motor, sensor means for actuating the motor through the power supply upon detection of a predetermined external stimulus such as sound of a predetermined level or more. Also, the figure moving article includes a transmission mechanism operatively connected between the drive mechanism and one of the lid members of the casing to transmit the output of the motor to the one lid member to actuate the one lid member in relation to the other of the lid members.

In a preferred embodiment of the present invention, the transmission mechanism comprises a gear mechanism and the figure moving article also includes elastic means for constantly urging the one lid member in a direction of displacing or separating the one lid member from the other lid member. Alternatively, it may comprise a link mechanism. Such construction permits the one lid member to carry out a circular movement with respect to the other lid member.

In another preferred embodiment of the present invention, the transmission mechanism comprises cam means operatively connected to the motor of the drive mechanism and oscillation means operatively connected between the cam means and the one lid member and the one lid member is actuated so as to carry out an oscillation movement with respect to the other lid member.

Accordingly, it is an object of the present invention to provide a figure moving article which is capable of exhibiting unique motion sufficient to give a viewer much interest and surprise.

It is another object of the present invention to provide a figure moving article which is capable of establishing a surprise visual communication with a viewer.

It is a further object of the present invention to provide a figure moving article which is capable of responding to any action of a viewer such as talking to the article, his hand clapping or the like.

It is still another object of the present invention to provide a figure moving article which is capable of providing a viewer with much interest and surprise.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which like reference numerals designate like or corresponding parts throughout; wherein.

DETAILED DESCRIPTION OF THE PREFERRED EMBODIMENTS

Now, a figure moving article according to the present invention will be described hereinafter with reference to the accompanying drawings.

Figure 1:
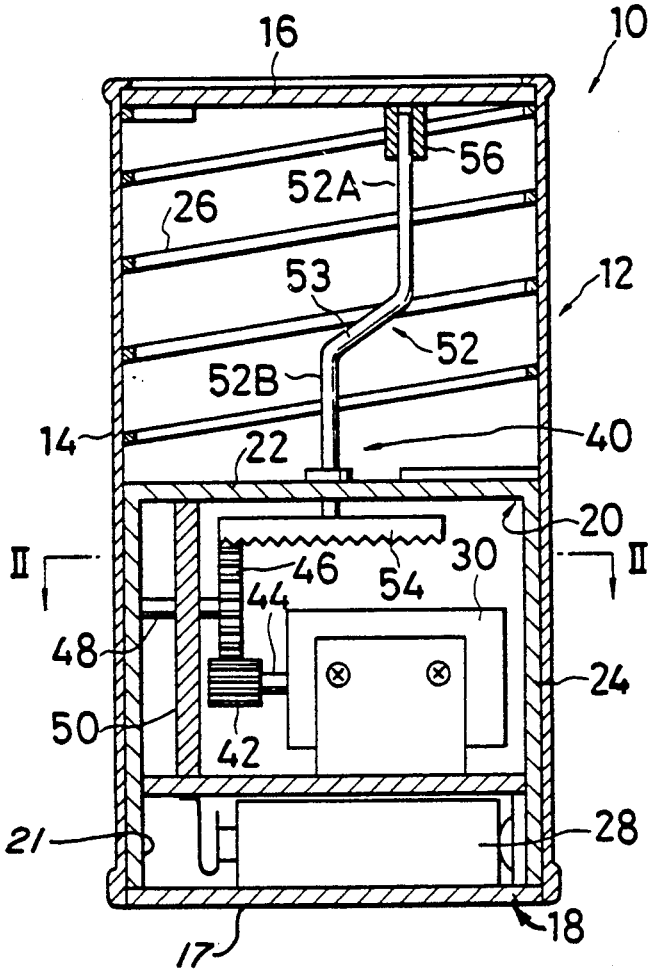
FIG. 1 is a vertical sectional view showing an embodiment of a figure moving article according to the present invention.
Figure 2:
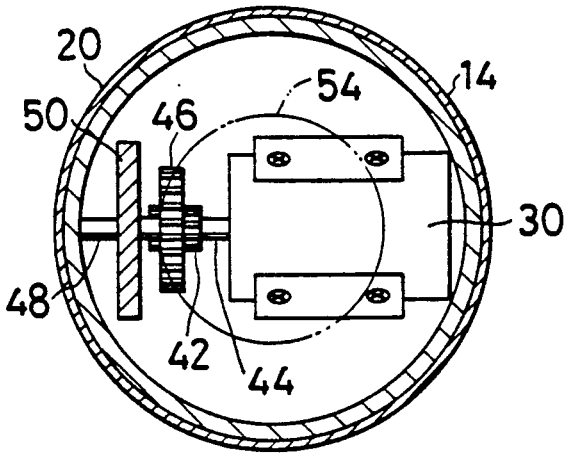
FIG. 2 is a sectional view taken along line II—II of FIG. 1.
Figure 3:
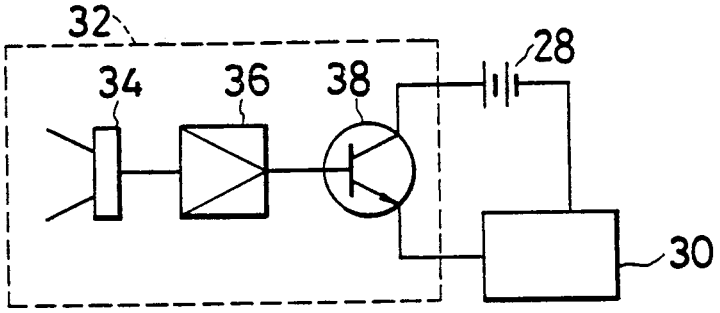
FIG. 3 is a schematic circuit diagram showing an electric circuit incorporated in the figure moving article shown in FIG. 1.
Figure 4C:
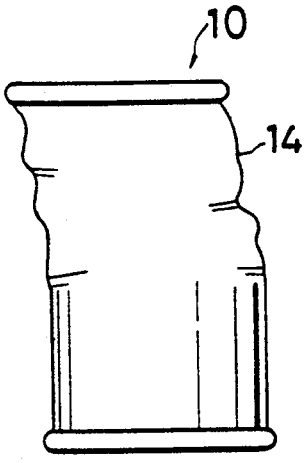
FIGS. 4A to 4C each are a front elevation view showing the manner of operation of the figure moving article shown in FIG. 1.
Figure 4B:
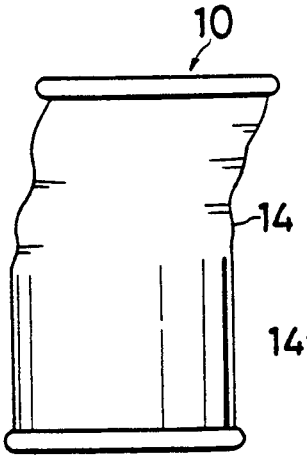
Figure 4A:
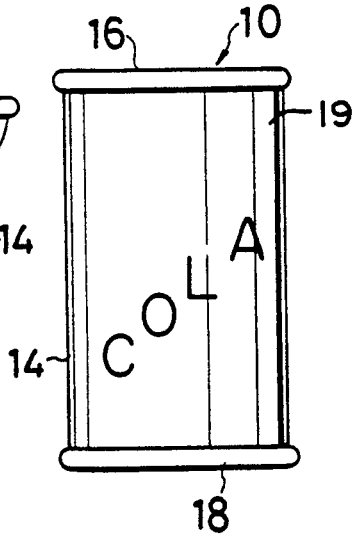

Referring now to FIGS. 1 to 3 showing a first embodiment of a figure moving article according to the present invention, a figure moving article of the illustrated embodiment generally indicated at reference numeral 10 includes a casing 12, which, in the illustrated embodiment, is formed into a cylindrical shape. More specifically, it is formed into an annular shape in cross section so as to exhibit a can-like appearance such as a soda or beer can as shown in FIG. 4A. For this purpose, the casing 12 includes a hollow cylindrical member 14 of an annular shape in cross section serving as a side wall of the casing 12 and opened at the upper and lower ends thereof, and an upper lid member 16 and a lower lid member 18 which respectively serve as upper and lower end walls of the casing 12 for closing the upper and lower open ends of the cylindrical member 14. The cylindrical member 14 is made of a deformable or flexible material such as a vinyl chloride sheet material or the like. The upper and lower lid members 16 and 18 may be made of a rigid material such as a rigid plastic material.

The figure moving article 10 also includes a base 20 formed into a hollow cylindrical shape and closed at the upper end thereof with a cover 22. The base 20 is fittedly received in the lower portion of the casing 12 and fixedly mounted on the lower lid member 18. The base 20 includes a peripheral side wall 24 which is fixed at the outer surface thereof to the inner surface of the flexible cylindrical member 14 by means of, for example, an adhesive material. The flexible cylindrical member 14 of the casing 12 is fixed at the upper end thereof to the outer periphery of the upper lid member 16 by, for example, fusion. In the illustrated embodiment, the cylindrical member 14 of the casing 12 may be provided on the outer surface thereof with any desired pattern 19 suitable for a can design by, for example, printing, see FIG. 4A.

Further, the figure moving article 10 of the illustrated embodiment includes elastic means to constantly urge or force the flexible cylindrical member 14 away from the base 20 to cause the casing to normally keep a can-like shape or container appearance. In other words, the elastic means serves to relatively urge the upper lid member 16 with respect to the lower lid member 18 in a direction of separating the upper lid member from the lower lid member. In the illustrated embodiment, the elastic means comprises a coiled spring 26 arranged in the casing 12 so as to constantly urge the upper lid member 16 in the upper direction. More particularly, the coiled spring 26 is arranged in a manner to be interposed between the upper cover 22 of the base 20 and the upper lid member 14 and fitted in the flexible cylindrical member 14. Alternatively, the elastic means may be constructed by forming the flexible cylindrical member 14 of a material exhibiting restoring force such as a rubber sheet material, an elastic plastic sheet material or the like. Such construction of the elastic means eliminates the arrangement of the coiled spring 26.

The figure moving article 10 further includes a drive mechanism and a transmission mechanism for transmitting the output of the drive mechanism therethrough to the casing 12 to permit the upper lid to substantially horizontally carry out circular movement in relation to the lower lid. More particularly, the drive mechanism includes a power supply 28 and a drive source 30 which are arranged in base 20 and electrically connected to each other. In the illustrated embodiment, the power supply 28 may comprise at least one dry cell battery and the drive source 30 may comprise a miniature motor. The lower lid member 18 may be formed with a closable opening portion 17 which permits the power supply 28 to be replaceably received within a compartment 21 within the base 20. The power supply 28 and drive source 30 may be preferably arranged at the bottom of the base 20. Such arrangement permits the center of gravity of the figure moving article to be low, to thereby contribute to the stabilization of the article.

The drive mechanism also includes sensor means 32 arranged on the base 20. In the illustrated embodiment, the sensor means 32, as shown in FIG. 3, includes a microphone 34 serving as a sound sensor element, an amplifier 36 connected to the microphone 34 to amplify the output of the microphone 34 and a switch element 38 connected to the amplifier 62 and adapted to be operated depending upon the amplified output of the amplifier. The switch element 38 is connected to the power supply 28 and drive source 30 so that the output of the power supply 28 may be supplied to the drive source 30 when the switch element 38 is turned on. Alternatively, a photosensor may be substituted for the sound sensor 34 so that the sensor means 32 may detect the access of a viewer or visitor to the figure moving article. The photosensor may be arranged in a hole formed at the cylindrical member 14 of the casing 12.

The transmission mechanism, which is generally designated at reference numeral 40, is adapted to convert rotation of the drive source or motor 30 to another movement and transmit it to the upper lid member 16, to thereby cause the upper portion of the casing to carry out any shape deforming movement such as bending, torsion, rotation, contraction or the like. More particularly, in the illustrated embodiment, the transmission mechanism 40 comprises a gear mechanism adapted to transmit the rotation of the motor 30 to the upper lid member 16 to permit it to carry out substantially horizontal circular movement with respect to the lower lid member 18. For this purpose, the transmission mechanism 40 shown in FIG. 2 includes a gear 42 mounted on a revolving shaft 44 of the drive source or motor 30, a reduction gear 46 rotatably supported on a support shaft 48 held on a support 50 provided in the base 20 and engaged with the gear 42, a crown gear 54 engaged with the reduction gear 46, and an actuation shaft 52 operatively connected between the crown gear and the upper lid member 16 so as to transmit rotation of the crown gear 54 to the upper lid member 16 to cause it to carry out the circular movement. For this purpose, the actuation shaft 52 is bent at the intermediate portion thereof indicated at reference numeral 53, resulting in being separated into an upper portion 52A and a lower portion 52B with the intermediate bent portion 53 being interposed therebetween. In the illustrated embodiment, the actuation shaft 52 is so bent that the upper and lower portion extend substantially parallel to each other and be eccentric with each other. The actuation shaft 52 is rotatably fitted at the upper end thereof in a bearing 56 mounted on the lower surface of the upper lid member 16.

Now, the manner of operation of the figure moving article of the illustrated embodiment constructed as described above will be described hereinafter with reference to FIG. 4 as well as FIGS. 1 to 3.

When the figure moving article 10 is placed in a silent atmosphere, the elastic means permits the article to be kept at such an erect and straight form as normally seen in a can, as shown in FIG. 4A. Then, when the sensor means 32 detects a predetermined external stimulus or sound of a predetermined level or more such as hand clapping, talking to the article, pounding on a table on which the article is put, or the like, it actuates the power supply or dry cell 28 to supply its output to the drive source or motor 30, resulting in the motor 30 being actuated or rotated. Then, the rotation of the motor 30 is transmitted through the transmission mechanism 40 to the upper lid member 16, during which the actuation shaft 52 may be rotated about the central axis of the lower portion 52B positioned below the intermediate bent portion 53 and operatively connected to the crown gear 54. This causes the upper end of the upper portion 52A of the actuation shaft 52 and therefore the upper lid member 16 to carry out substantially a horizontal circular motion about the axis of the lower portion 52B at a radius corresponding to the distance between the axis of the upper portion 52A and that of the lower portion 52B, so that the flexible cylindrical member 14 of the casing 12 may be moved or deformed in turn as shown in FIGS. 4B and 4C. Such deformation of the cylindrical member 14 and therefore the casing 12 is repeated so long as the sensor means 32 detects sound of a predetermined level or more.

Figure 5:
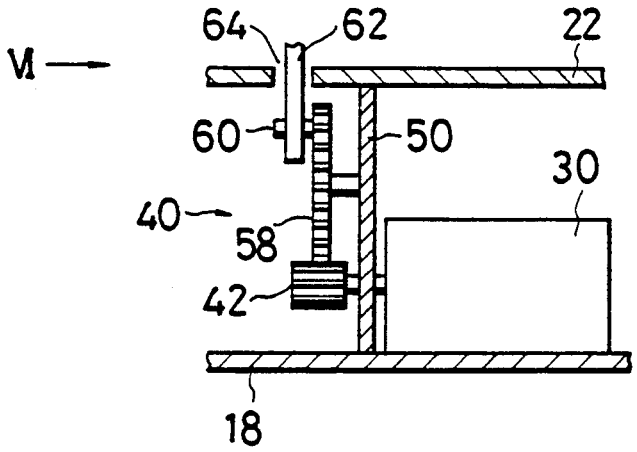
FIG. 5 is a fragmentary sectional view showing an essential part of another embodiment of a figure moving article according to the present invention.
Figure 6:
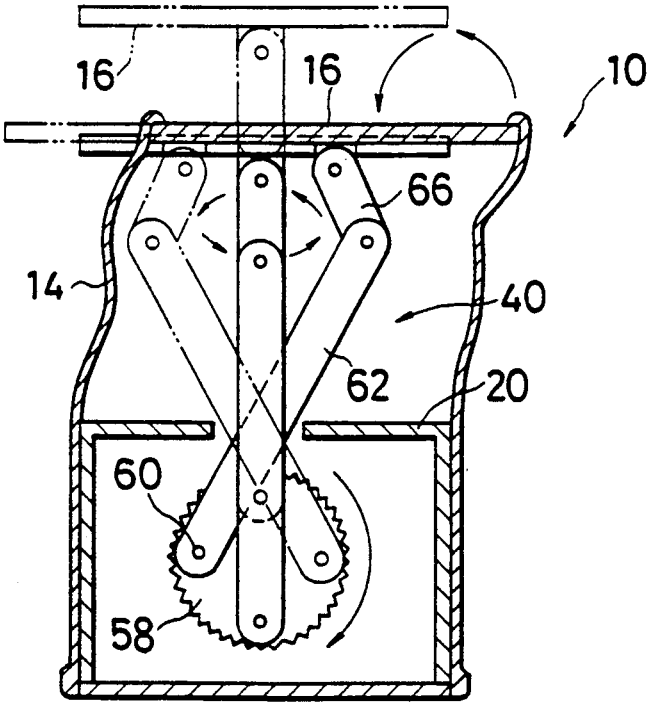
FIG. 6 is a sectional view taken along an arrow VI of FIG. 5 which shows the manner of operation of the figure moving article of FIG. 5.

FIGS. 5 and 6 show a second embodiment of a figure moving article according to the present invention and more particularly a transmission mechanism incorporated in the second embodiment. In a figure moving article shown in FIGS. 5 and 6, a transmission mechanism 40 comprises a link mechanism for causing an upper lid member to carry out substantially horizontal circular movement with respect to a lower lid member as in the first embodiment described above. For this purpose the transmission mechanism 40 includes a small gear 42 mounted on a revolving shaft 44 of a drive source or motor 30 and a large gear 58 rotatably mounted on a support 50 and engaged with the small gear 42. The large gear 58 is provided on the outer surface of the peripheral portion thereof with a cam pin 60 so as to project therefrom. The transmission mechanism 40 also includes a first link 62 arranged in a manner to be inserted through a hole 64 formed through a cover 22 of a base 20 and supportedly fitted at the lower end thereof in the cam pin 77, and a second link 66 arranged in a manner to be pivotally mounted at the lower end thereof on the upper end of the first link 62 and likewise pivotally mounted at the upper end thereof on the lower surface of an upper lid member 16. The remaining part of the second embodiment may be constructed in substantially the same manner as the first embodiment described above.

In the second embodiment constructed as described above, when, sensor means 32 detects sound of a predetermined level or greater to actuate the motor 30 through a power supply or dry cell 28, the cam pin 60 may carry out vertical circular movement with rotation of the large gear 58, resulting in the upper lid member 16 carrying out substantially horizontal circular movement with respect to a lower lid member 18 with the movement of the cam pin 60. Thus, it will be noted that in the second embodiment, the casing 12 carries out figure deforming movement such as expansion, contraction, bending and/or the like as in the first embodiment described above.

Figure 7:
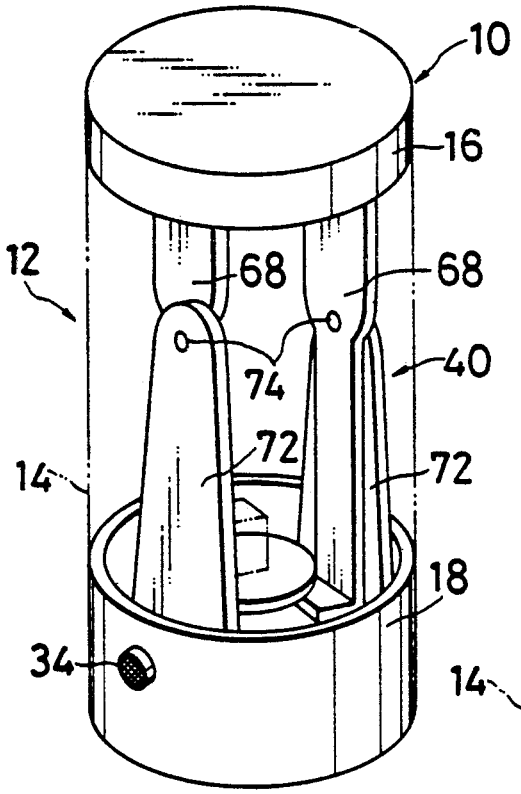
FIG. 7 is a perspective view showing an internal structure of a further embodiment of a figure moving article according to the present invention.
Figure 8:
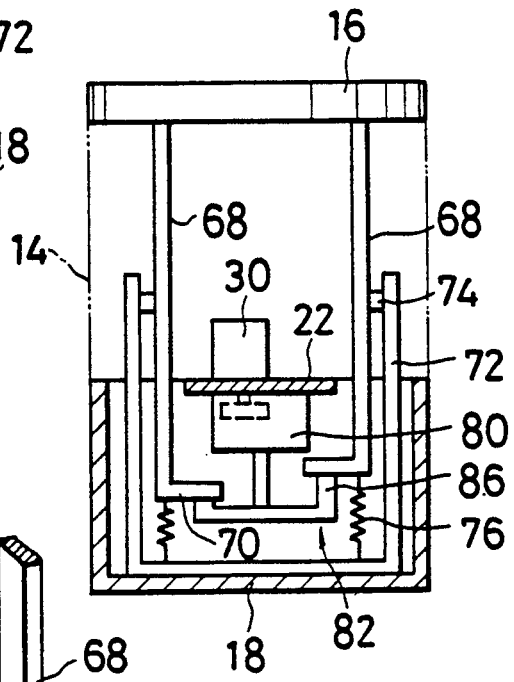
FIG. 8 is a front elevation view partly in section of the figure moving article shown in FIG. 7.
Figure 9:
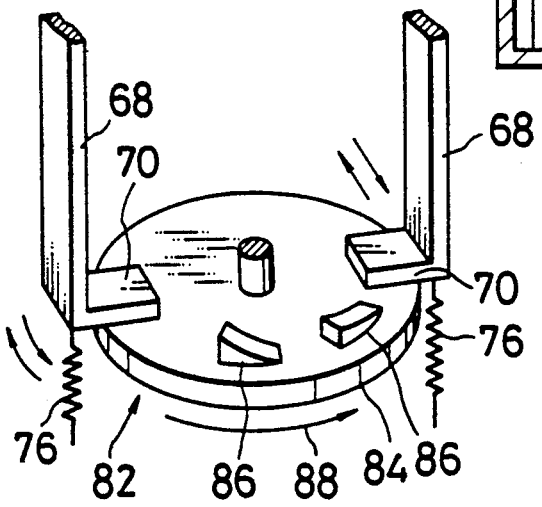
FIG. 9 is a fragmentary perspective view showing the relationship between arms and a cam constituting a transmission mechanism in the figure moving article shown in FIG. 8.

FIGS. 7 to 9 show a further or third embodiment of a figure moving article according to the present invention, particularly, a transmission mechanism incorporated in the embodiment. In a figure moving article of the illustrated embodiment, a transmission mechanism 40 comprises an oscillation mechanism adapted to cause an upper lid member to carry out substantially horizontal oscillation movement with respect to a lower lid member. For this purpose, the transmission mechanism 40 includes an upper support assembly having a pair of arms 68 formed at the lower end thereof with inward directed projections 70 aligned in a manner to be opposite to each other and mounted at the upper end thereof on the lower surface of an upper lid member 16 and a lower support assembly having a pair of support legs 72 arranged corresponding to the arms 68 and mounted at the lower end thereof on the upper surface of a lower lid member 18. The support legs 72 each are pivotally connected at the upper end thereof to the intermediate portion of each of the arms 68 through a pin 74, so that the upper lid member 16 may be pivotally supported through the arms 68 on the support legs 72 and therefore the lower lid member 18. Between the lower end of each of the arms 68 and the lower lid member 18 is interposedly arranged a spring 76 which acts to constantly downward urge the arm 68, to thereby normally keep a casing 12 at a erect straight posture.

In the illustrated embodiment, the lower lid member 18 is formed into a relatively flat cylindrical shape of which the upper end thereof is open. The lower lid member 18 is provided therein with an upper cover or mount plate 78 in a manner to be positioned above the projections 70 of the arms 68 and on substantially the same level as the upper end of the lower lid member 18. On the mount support 78 is mounted a drive source or motor 30, which is operatively connected through its revolving shaft to a reduction gear 80 mounted on the mount plate 78. The transmission mechanism 40 also includes cam means 82 including a disc 84 and at least one cam projection 86 mounted on the upper surface of the disc 84. In the illustrated embodiment, two such cam projections 86 are arranged on the disc 84. The cam projections 86 each may be inclinedly formed so that its distal end and proximal end as defined in a direction of rotation of the cam means 82 indicated at an arrow 88 are lowered and raised, respectively. The remaining part of the third embodiment may be constructed in substantially the same manner as the first or second embodiment described above.

In the figure moving article of the third embodiment constructed as described above, when the figure moving article is placed in a silent atmosphere, it is kept at an erect and straight posture. Then, when sensor means 32 detects sound of a predetermined level or more through a microphone 34, it actuates the motor 30 through a power supply (not shown), resulting in the cam means 82 being rotated in a predetermine direction. This causes the cam projection 86 of the cam means 82 to repeatedly move the projections 70 of the arms 68 against the spring 76 in the direction of rotation of the cam means 82 every time when the cam projection 86 passes under the projection 70. The so-moved projections 70 each are returned to the original position by the spring 76 after the projection 86 runs past the projection 70, so that the upper lid member may carry out oscillation movement with respect to the lower lid member 18. In the illustrated embodiment, the two projections 86 cause the two arms 68 to be alternately pivotally moved back and forth two times every time when the cam means 82 is rotated once, so that the casing of a can-like appearance may be pivotally moved back and forth.

In the embodiments described above, the casing 12 is formed into a can-like shape or appearance. The formation of the casing 12 into an appearance imitating an ornament which has been conventionally considered to be stationary gives a viewer more interest and surprise. However, it may be formed in imitation of any pet.

As can be seen from the foregoing, the figure moving article of the present invention is constructed so as to actuate or carry out deformation such as torsion, bending, rotation, expansion, contraction or the like in response to the action of a viewer such as hand clapping, vibration or the like, resulting in giving a viewer much interest and surprise and establishing any communication with the viewer.

It will thus be seen that the objects set forth above, among those made apparent from the preceding description, are efficiently attained and, since certain changes may be made in the above construction without departing from the spirit and scope of the invention, it is intended or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A novelty can capable of simulating the appearance of a container, comprising:

rigid upper and lower circular lid members of substantially the same size;

a cylindrical flexible casing, shaped to simulate the casing of a can, being attached to, respectively, the upper and lower lid members and extending between them to enclose a space between the upper and lower lid members;

a motor assembly contained between the upper and lower rigid lid embers, operatively connected to relatively move the upper and lower lid members both towards and away from each other in vertical and horizontal directions, the flexible casing member being deformed from and returned to a cylindrical shape during a cycle of relative movement of the upper and lower lid members, and means for sensing sound contained between the upper lid member and a lower surface of the lower lid member and connected to the motor assembly, whereby the motor assembly can be activated by sound to cause movement of the novelty can.

2. The novelty can of claim 1 further including resilient means for biasing the cylindrical flexible casing into a stationary cylindrical shaped configuration, the can having a central axis and the motor assembly relatively moving the lid members so that the upper lid member is moved both parallel to the central axis and transverse to the central axis.

3. The novelty can of claim 1 wherein the upper and lower lid members are formed of a rigid plastic material.

4. The novelty can of claim 1 wherein a coiled spring biases the upper lid ember away from the lower lid member.

5. The novelty can of claim 1 wherein the lower lid member has a compartment for receiving batteries and the motor assembly is mounted above the compartment.

6. The novelty can of claim 1 wherein the means for sensing sound includes a microphone mounted on the lower lid member.

7. The novelty can of claim 2 further including an upper support assembly connected to the upper lid member and having a pair of support legs extending downward towards the lower lid member and a lower support assembly connected to the lower lid member and pivotally connected o the upper support legs, the motor assembly connected to move the upper support legs.

8. A battery operated movable novelty device capable of simulating the appearance of a hand-held elongated container, comprising:

an upper lid member providing a rigid cylindrical configuration;

a lower lid member providing a rigid cylindrical configuration, the lower lid member having a compartment accessed through a closable opening portion;

a battery member positioned within the lower lid member compartment;

a motor assembly mounted on the lower lid member and operatively connected to the battery member;

a flexible cylindrical casing, shaped to simulate the casing of the container, the casing being attached to, respectively, the upper and lower lid members and enclosing the motor assembly;

means for biasing the upper and lower lid members away from each other to cause the flexible cylindrical casing to assume a cylindrical shape in a stationary position, and means, connected to the motor assembly, for moving the upper and lower lid members successively towards and away from each other to cause the flexible casing member to be disposed from and returned to a cylindrical shape during a cycle of movement, whereby the container appearance can amuse an observer by apparently deviating from its normally stationary solid configuration and returning to the configuration.

9. The novelty device of claim 8 further including means for sensing sound to enable an operation of the motor assembly in response to the sound.

10. The novelty device of claim 9 wherein the means for moving includes an upper rigid support assembly that can move the upper lid member relative to the lower lid member in both a horizontal and a vertical direction.

11. The novelty device of claim 10 wherein the biasing means includes a coiled spring to bias the upper lid member away from the lower lid member.

12. The novelty device of claim 11 wherein the lower lid member has a compartment for receiving batteries and the motor assembly is mounted above the compartment.

13. The novelty device of claim 12 wherein the means for sensing sound includes a microphone mounted on the lower lid member.

14. The novelty device of claim 13 wherein the upper support assembly has a pair of support legs extending downward towards the lower lid member and a lower support assembly is connected to the lower lid member and pivotally connected to the upper support legs, the motor assembly being connected to move the upper support legs.

15. A self-contained, hand-held novelty device, comprising:

an upper rigid lid member;

a lower rigid lid member;

a source of power mounted on the lower rigid lid member;

a flexible, cylindrically shaped material attached, respectively, about its perimeter edges to the upper and lower rigid lid members and extending between them;

a motor assembly mounted within the flexible cylindrical material, and transmission means connected to the motor and operable to move the upper rigid lid member relative to the lower rigid lid member to cause the cylindrically shaped material to be deformed from and returned to a cylindrical shape, the transmission means causing relative movement of the upper and lower lid members both towards and away from each other in vertical and horizontal directions.

16. The novelty device of claim 15 further including resilient means for biasing the cylindrical flexible material into a stationary cylindrical shaped casing configuration.

17. The novelty device of claim 15 wherein the upper and lower lid members are formed of a rigid plastic material.

18. The novelty device of claim 15 wherein a coiled spring biases the upper lid member away from the lower lid member.

19. The novelty device of claim 15 wherein the lower lid member has a compartment for receiving batteries and the motor assembly is mounted above the compartment.

20. The novelty device of claim 19 further including means for sensing sound and actuating the motor assembly in response to the sensed sound.

21. The novelty device of claim 20 wherein the means for sensing sound includes a microphone mounted on the lower lid member.

22. The novelty device of claim 21 further including an upper support assembly connected to the upper lid member and having a pair of support legs extending downward towards the lower lid member and a lower support assembly connected to the transmission means and pivotally connected to the upper support legs, the motor assembly connected to move the upper support legs.

* * * * *